US005395165A

United States Patent [19]

Woerner

[11] Patent Number: 5,395,165

[45] Date of Patent: Mar. 7, 1995

[54] SUSPENSION SYSTEM FOR POCKET-TYPE DOORS

[75] Inventor: Axel G. Woerner, Greensboro, N.C.

[73] Assignee: Häfele America Co., Archdale, N.C.

[21] Appl. No.: 37,018

[22] Filed: Mar. 25, 1993

[51] Int. Cl.[6] ..... E06B 1/00; A47F 7/00

[52] U.S. Cl. ..... 312/110; 211/27

[58] Field of Search ..... 312/322, 331, 309–311, 312/109–110; 49/254; 211/27, 94; 108/40

[56] References Cited

U.S. PATENT DOCUMENTS

| | | | |
|---|---|---|---|
| 865,114 | 9/1907 | Mapes | 312/110 X |
| 2,667,400 | 1/1954 | Wotring | 312/331 |
| 4,729,612 | 3/1988 | Stone | 312/109 |
| 4,974,912 | 12/1990 | Rask et al. | 312/110 |
| 4,976,502 | 12/1990 | Kelley et al. | 312/331 X |
| 5,078,461 | 1/1992 | Beck et al. | 312/331 X |
| 5,149,180 | 9/1992 | Haab et al. | 312/322 |

FOREIGN PATENT DOCUMENTS 1143415 4/1958 Germany .

*Primary Examiner*—Stephen C. Pellegrino
*Assistant Examiner*—Nancy Mulcare
*Attorney, Agent, or Firm*—Rhodes, Coats & Bennett

[57] ABSTRACT

A cabinet door or doors are each hingedly mounted to the slide brackets of a pair of slide track assemblies which, in turn, are secured to a side wall of a cabinet. A pair of inelastic cables of substantially the same length connect the upper and lower slide brackets in a prescribed configuration to prevent skewing of the slide brackets at all times. One of the cables extends rearwardly from the upper bracket across an upper rear pulley, downwardly and forwardly around a lower front pulley and back into the lower bracket. The other cable follows the opposite path from the upper bracket forwardly around an upper front pulley, downwardly and rearwardly around a lower rear pulley, and forwardly into the lower bracket. Because the cables are of equal length, they insure that vertical alignment is maintained.

15 Claims, 3 Drawing Sheets

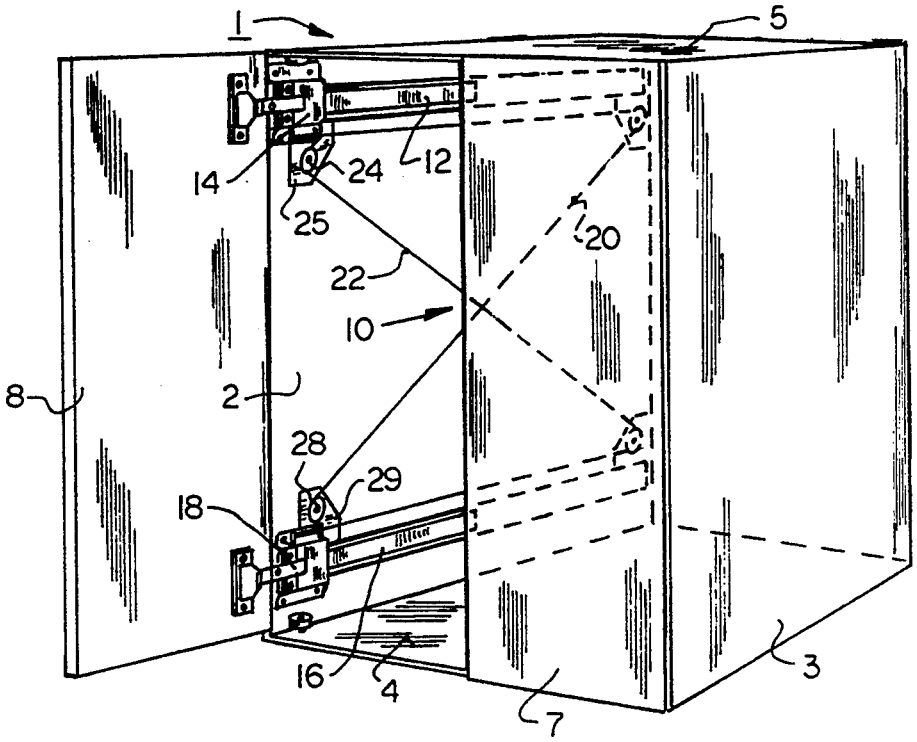
FIG. 1
FIG. 2
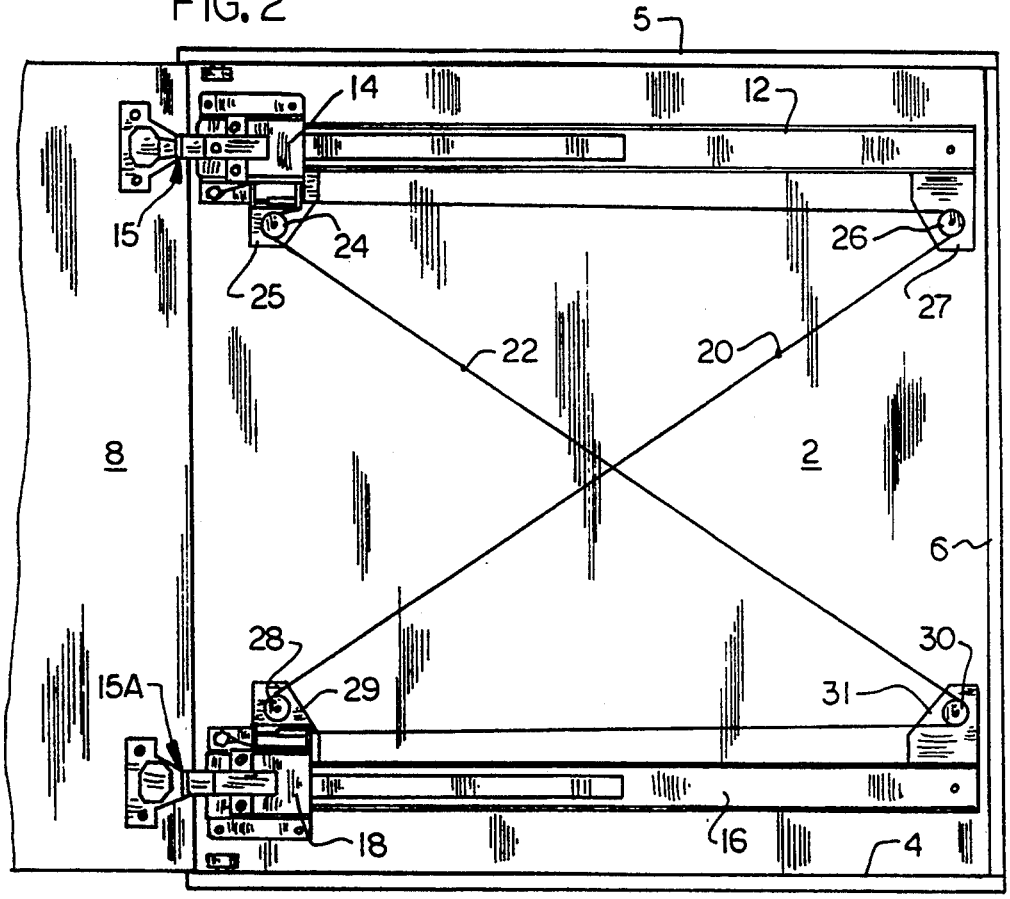

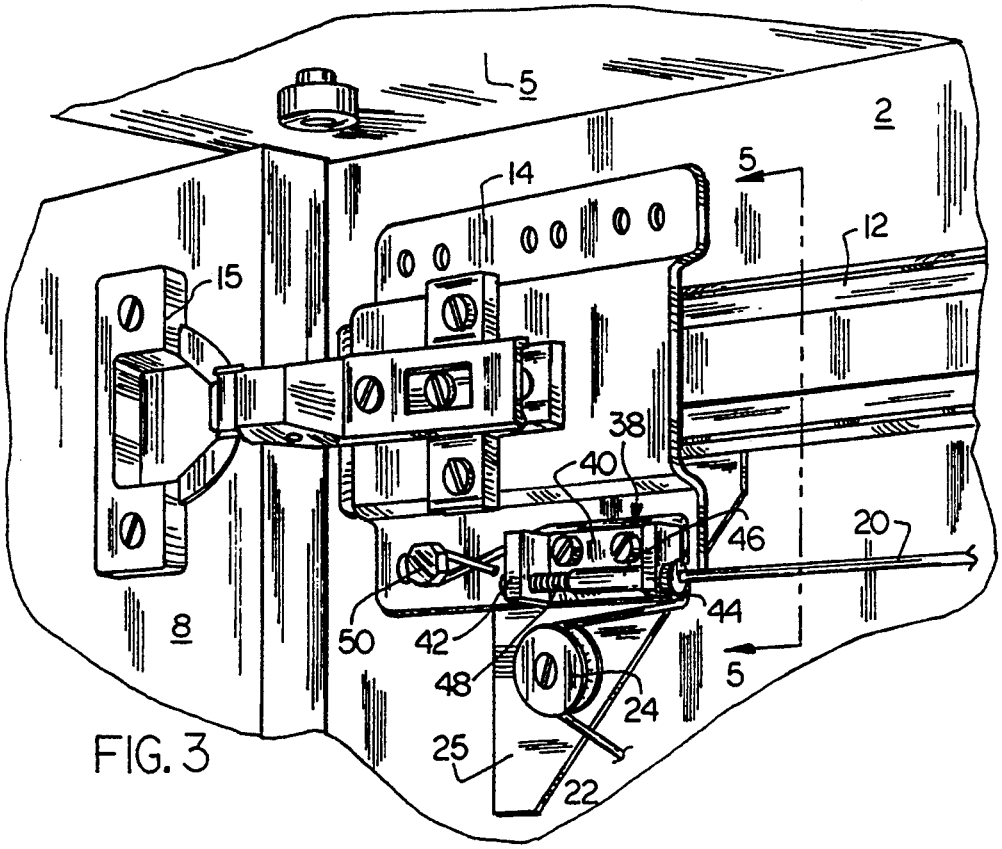
FIG. 3
FIG. 4
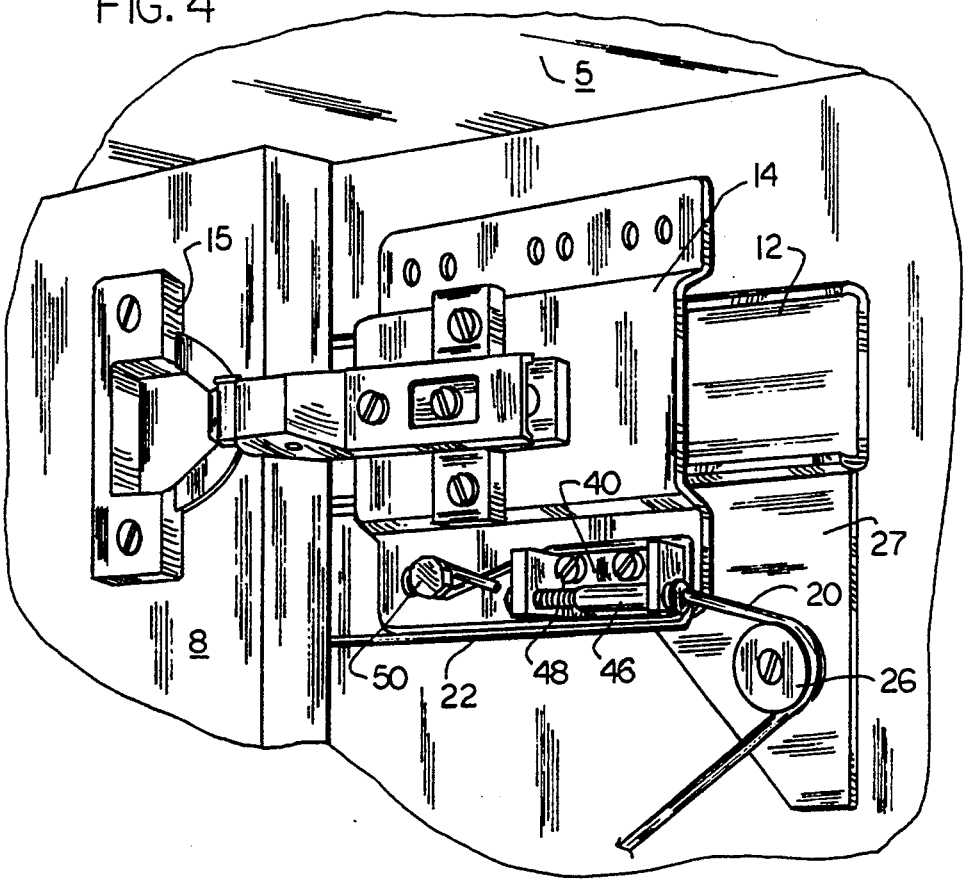

SUSPENSION SYSTEM FOR POCKET-TYPE DOORS

BACKGROUND AND SUMMARY OF THE INVENTION

The present invention is directed to pocket door cabinets and, more particularly, to an improved door suspension system which insures that the slide brackets move smoothly and do not bind.

Pocket door systems have become increasingly popular in recent years. In such systems, one or two doors are used to cover the front opening of a cabinet, such as an entertainment center. Each door is hingedly mounted at the top and bottom of the side edge thereof to a slide bracket which is mounted on a pair of parallel horizontal tracks affixed to the inner side wall of the cabinet. After the door(s) swings open from a closed position, it is then slid along the tracks into retracted parallel relationship with the adjacent side wall. While the cabinet door or doors are generally opened by pivoting about a vertical axis along the outside edge, on some occasions (bookcases with flipper-type doors) the cabinet door may open by pivoting about a horizontal axis.

In such pocket door systems, it is important that the sliding fittings which connect the top and bottom of the door to the slide tracks operate smoothly without binding. Binding is sometimes caused by the weight of the door pulling forwardly on the upper fitting moving it out of vertical alignment with the lower fitting. Conversely, a force exerted against the upper portion of the door, as when moving it rearwardly, can also cause the upper fitting to move rearwardly further than the lower fitting, thus creating a misalignment situation.

Various approaches to resolving the aforesaid problem have appeared in the prior art. Some manufacturers rigidly connect the upper and lower fittings by a vertical wooden or metal plate which prevents skewing of the fittings. Another approach utilizes a vertical rod connecting the upper and lower fittings, which rod has a pinion at each end thereof operatively fitting into a rack extending along the top and bottom of the inner wall. The cooperation between the vertical rod and the rack and pinion assemblies thereby prevent misalignment and binding of the slide assemblies. In a third approach, the door is hinged on a scissor-pantograph type hinge and simply slides along a path parallel to the end wall without binding. While the above mechanisms are apparently reliable and seem to adequately solve the skewing problem in such types of doors, they are very expensive, and therefore are generally used only in more expensive furniture.

A less expensive approach is to connect the upper and lower hinge plates by means of a cable which extends over a plurality of pulleys to transmit the force tending to skew the bottom hinge to the top hinge. One example of this approach is shown in the German Patent No. 1,143,415 to Ziehl and the U.S. Pat. No. 4,729,612 to Stone. Both of these arrangements are substantially similar to each other and provide a cable with the ends thereof affixed to the top and bottom hinge plates. The cable extends in a Z path from the upper hinge plate across a pulley at the rear end of the top slide and down across another pulley at the front end of the bottom slide and back to the bottom hinge plate.

A second example of such a cabling arrangement is shown in U.S. Pat. No. 4,974,912 to Rask et al. In this approach, two cables are provided, each attached at one end to the back end of one fixed slide member and at the other end to the front end of the other fixed slide member. Each cable is slidably attached to the movable members of the slide assemblies such that the pair of cables trace an "I" figure. The pair of cables in this arrangement effectively prevent the movable members of the slide assemblies from moving out of a predetermined relationship to each other.

In the present invention, yet another approach is provided whereby equilibrium of the pocket door system is established and maintained. Thus the present approach is a pre-balanced system in which the weight of the door does not change the equilibrium. Only fine adjustments are necessary to allow for door, cabinet, and gap variations. While extremely effective, the system of the present invention is extremely simple, has minimized the number of parts, and facilitates assembly and service.

In the present suspension system, two cables are utilized, one of which extends rearwardly from the upper bracket across an upper rear pulley, downwardly and forwardly around a lower front pulley and back into the lower bracket. A second cable follows the opposite path from the upper bracket forwardly around an upper front pulley, downwardly and rearwardly around a lower rear pulley, and forwardly into the lower bracket. Both cables are of equal length and substantially inelastic.

By having two cables, skew from both downward and upward forces are prevented. Parallel movement of the slide brackets is maintained. This occurs because the two cable arrangement insures tension on the cable arrangement regardless of whether the skewing component force is downward or upward. In either case, the brackets remain one atop the other.

Further improvements in the present invention include the assembly of the front and rear pulleys onto the drawer slides themselves at predetermined engineered locations, rather than being separately attached to the side walls. This makes the slide assemblies easier and faster to assemble and mount and thus less expensive. Further, the pre-assembly of the pulleys to the slide brackets insures proper positioning of the components. The only thing necessary for the installer to do is to insure that the slides are parallel, then everything functions correctly.

A second feature of the present invention is the provision of an adjustment device mounted on each slide bracket by which the length of each cable may be adjusted by a simple screw device. The bracket and screw arrangement is so positioned that the screw head faces the front of the cabinet. Thus the adjustment screw is accessible from the front direction when the door is open which considerably facilitates adjustment.

In general, the present invention is directed to a pocket door suspension system for hingedly mounting a pocket type cabinet door for pivotal movement between a closed position in which the door is perpendicular to a cabinet side wall and an open position in which the door is parallel to and alongside the cabinet side wall. In the open position, the door is adapted for sliding movement relative to the side wall. The suspension system includes an upper and lower slide track assembly mounted to the cabinet side wall in parallel spaced arrangement to each other. A slide bracket is attached to each slide track assembly for movement therealong.

Each of the slide brackets are hingedly connected to the edge of the cabinet door. The suspension system is, in reality, an alignment mechanism for maintaining the slide brackets in vertically aligned relationship. Toward this end, the suspension system includes a first and second cable and a plurality of pulleys. One of the pulleys is mounted adjacent each of the front and rear ends of the upper and lower slide track assemblies. The first cable is connected to the upper slide bracket and extends rearwardly therefrom over the pulley at the rear end of the upper slide track assembly, downwardly to and over the pulley at the front end of the lower slide track assembly and rearwardly back to the lower slide bracket. The second cable is connected to the upper slide bracket and extends forwardly therefrom over the pulley at the front end of the upper slide track assembly, downwardly to and over the pulley at the rear end of the lower slide track assembly, then forwardly to the lower slide bracket.

The aforesaid cables are movable with the slide brackets during sliding movement between the open and closed positions of the door and maintain the vertical alignment of the slide brackets regardless of whether an upward or downward force is exerted on the door.

The cables are substantially inelastic and of the same effective length. In a preferred embodiment, the suspension system includes an adjustment mechanism associated with each of the cables for adjusting the effective length thereof. Preferably the adjustment mechanism is accessed from the front of the cabinet.

It is therefore an object of the present invention to provide a suspension system for pocket doors which insures that the slide brackets move smoothly and do not bind.

It is a further object of the present invention to provide a suspension system of the type described which is inexpensive and which is more easily assembled and installed within the cabinet.

A further object of the present invention is to provide a suspension system of the type described which maintains vertical alignment of the slide brackets regardless of whether the force on the corresponding door is upward or downward.

Yet a further object of the present invention is to provide a pocket door suspension system in which equilibrium is established and maintained without regard to the weight of the door or the force applied against it.

Other objects and a fuller understanding of the invention will become apparent from reading the following detailed disclosure of a preferred embodiment along with the accompanying drawings in which:

FIG. 1 is a perspective view of a cabinet including the hinge support system according to the present invention;

FIG. 2 is a front view of the inside of one side wall of the cabinet of FIG. 1 with the door in the open position illustrating the cable arrangement of the present invention;

FIG. 3 is an enlarged perspective view illustrating the front end of a slide track with the attached slide bracket and corresponding hinge;

FIG. 4 is a perspective view, with parts broken away, similar to FIG. 3, except illustrating the rear end of the slide track;

DETAILED DESCRIPTION OF A PREFERRED EMBODIMENT

Figure 5:
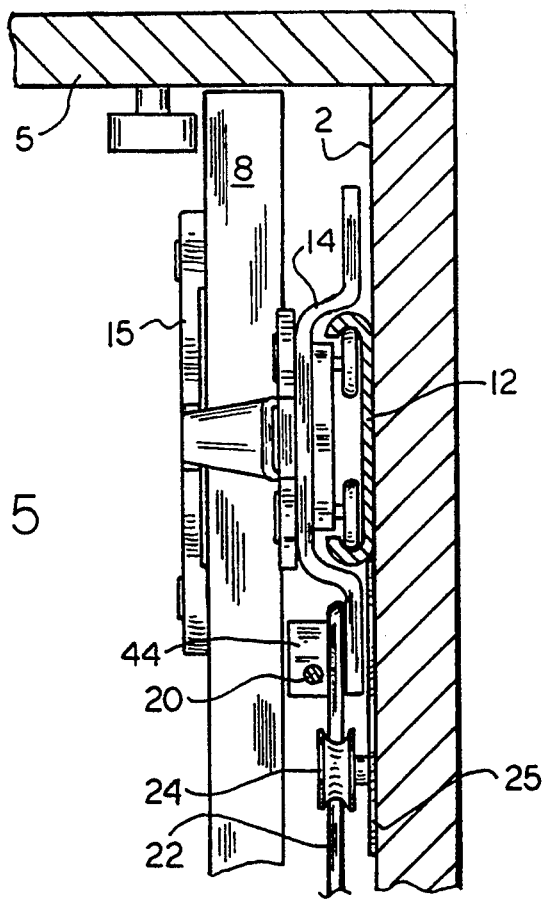
FIG. 5 is a cross-sectional view taken substantially along lines 5—5 in FIG. 3.

Turning now to the drawings, and particularly to FIG. 1, the present invention is described with reference to a cabinet 1 which includes side walls 2,3, a bottom wall 4, a top wall 5, and a rear wall 6. The cabinet 1 is provided with a pair of doors 7,8. Door 8 is shown in the open and unretracted position parallel to side wall 2. Door 7 is shown in the closed position. While the description hereinbelow will be directed to the type of cabinet illustrated in FIG. 1, it should be apparent that the hinge support system may be utilized for any type of door or panel in which the door or panel is first pivoted, then retracted along a pair of slides to lie adjacent a wall. Such structures may even include doors which pivot about a horizontal axis and then retract as are used in bookcases and file cabinets.

Also in FIG. 1, there is illustrated schematically on the inner surface of wall 2 the suspension system 10. The same suspension system is provided on wall 3. System 10 includes an upper slide track assembly 12 with a slide bracket 14 attached thereto and a lower slide bracket 16 also having a slide bracket 18 attached thereto. Slide tracks 12,16 are mounted on the inner surface of the side wall 2, one on the upper portion of the wall and the other on the lower portion of the wall. The slide tracks 12,16 should be horizontal and parallel to each other. In FIG. 1 there is also illustrated schematically the path of the two cables 20,22 which maintain the brackets 14,18 vertically aligned with each other. Thus the equilibrium of the pocket door system is established and maintained. The two wires 20,22 prevent both sag and upward skew during opening of the door. The two oppositely directed cables maintain a constant tension on the cables 20,22 regardless of whether the skewing component force is directed downwardly or upwardly.

Turning now to FIG. 2, there is better illustrated the cable arrangement and the hinging of the doors to the slide brackets 14,18. First of all, a conventional hinge mechanism 15 hingedly connects the inner surface of the outer edge of door 8 near the upper end thereof to slide bracket 14. In a similar manner, hinge 15A connects the lower edge of door 8 to hinge bracket 18. So arranged, when doors 7,8 are closed, the hinge brackets 14,18 are adjacent the front ends of tracks 12,16 and vertically aligned one over the other.

Slide track 12 includes a front pulley 24 and a rear pulley 26 attached to downwardly extending protuberances 25,27 formed unitarily with slide track 12. In the same manner, front pulley 28 and rear pulley 30 are attached to upwardly extending protuberances 29,31, respectively, on slide track 16. While it is possible that the abovementioned pulleys 24,26,28,30 could be attached to the inner wall 2 as in earlier approaches, this requires more time and effort in assembling the hinge support system 10 to the cabinets, as well as creating a greater possibility of error and misalignment. As also shown in FIG. 2, the first cable is so connected to upper bracket 14 that it extends rearwardly therefrom around pulley 26, then downwardly and forwardly over pulley 28, then rearwardly into attachment with lower bracket 18. Similarly, the second cable 22 extends generally forwardly from bracket 14 around the front upper pulley 24, then downwardly and rearwardly around lower rear pulley 30, then finally forwardly into attachment with the lower slide bracket 18. The cables 20,22 are preferably substantially inelastic and of the same length.

Turning now to FIG. 3, there is better illustrated the configuration of one of the slide brackets. While slide bracket 14 is illustrated in FIG. 3, it is apparent that slide bracket 18 is substantially the same construction with the cables attached to the upper portion. FIG. 3 shows the manner in which the cables are adjustably mounted to the slide brackets to insure the above-described operation. Looking at FIG. 3, there is provided an adjustment coupling 38 attached to the lower edge of bracket 14. Coupling 38 includes an adjustment bracket 40 in the form of a U-shaped block having upstanding end walls 42,44. An inwardly threaded tubular sleeve 46 is slidably extending through an opening in end wall 44. A threaded fastener 48 extends through end wall 42 into the sleeve 46. Obviously, the threaded fastener 48 mates with the threads in sleeve 46. The end of cable 20 is welded, swaged, or otherwise secured within the end of tubular member 46. Since the tubular member 46 slides within an opening in wall 44, adjustment of the cable 20 may be made by turning the screw 48. As the screw 48 turns into the sleeve 46, the threads cause the sleeve to move forwardly or to the left in FIG. 3. This increases the tension on upper cable 20. In this manner, the length or tension on cable 20 may be adjusted. Further, it should be noted that, when the door 8 is in an open position, this adjustment may be accomplished from the front with a screwdriver. There is no need to remove a television set or whatever else may be in the entertainment center, or for a workman to climb inside the cabinet. In the same manner, cable 22 is adjusted by the adjustment coupling on bracket 18.

In order to allow the bracket 14 to move forwardly the full extent of the slide track 12, after cable 22 extends around upper forward pulley 24, it extends in a rearwardly direction toward the bracket 40. Some type of attachment might be provided at the lower right-hand corner of bracket 14, however, since openings in the bracket are available elsewhere, the cable 22 is merely wrapped around the bracket 40 and extends forwardly to the attachment screw 50. However, the effect of cable 22 is to extend forwardly from the attachment point with bracket 14 around pulley 24, then downwardly and rearwardly. In other words, the cable 22 must extend forwardly around pulley 24, while cable 20 extends rearwardly from bracket 14 around upper rear pulley 26.

In operation, when the doors 7,8 are closed, the slide brackets 14,18 are in their forwardmost position. As the doors are opened, they are pivoted 90°, then a rearward force is exerted against the door and the slide brackets 14,18 begin to move rearwardly along tracks 12,16, respectively. The length of cable 20 between bracket 14 and upper pulley 26 begins to shorten, while the length of pulley 22 between front upper pulley 24 and bracket 14 begins to lengthen the same amount. This shortening and lengthening is equalized. The illustrated arrangement ensures tension on the cable regardless of forces exerted against the door. As a result, binding is eliminated and the brackets 14,18 always remain vertically aligned. This is sometimes referred to as the suspension system being in equilibrium.

Figure 6:
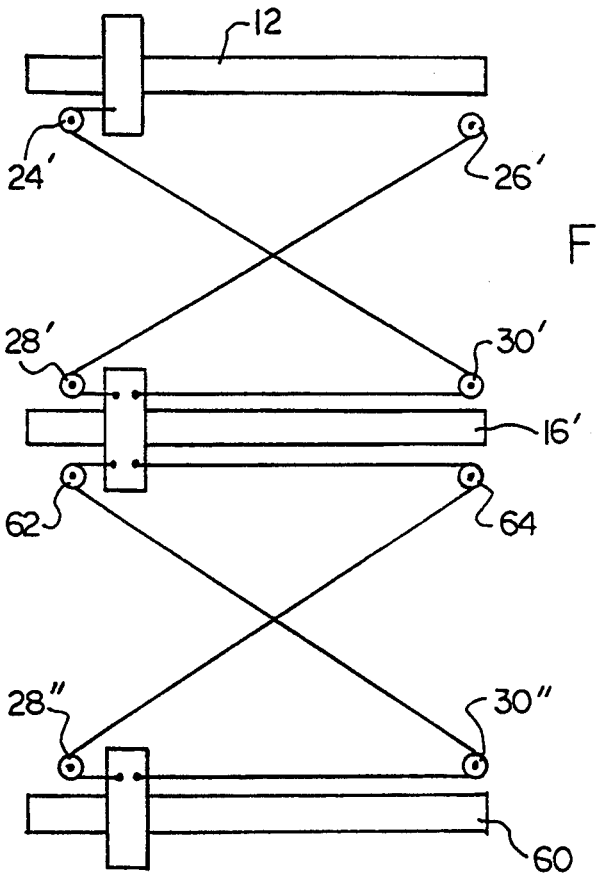
FIG. 6 is a schematic view of the cable system showing an alternate embodiment where three slide track assemblies are used for taller cabinets.

As illustrated in FIG. 6, for extremely tall cabinets, it is sometimes necessary to utilize three or even more slide track assemblies 12',16',60'. The situation is the same, and a cable suspension system as described hereinabove extends between each adjacent pair of slide tracks. In this arrangement, slide track 16' is modified to have front and rear pulleys 28',30',62,64 on both the top and bottom thereof. This arrangement is illustrated in FIG. 6.

While a preferred embodiment of the invention has been described hereinabove, it is apparent that various changes and modifications might be made without departing from the scope of the invention which is set forth in the accompanying claims.

I claim:

1. A pocket door suspension system for hingedly mounting a pocket-type cabinet door for pivotal movement between a closed position wherein the door is perpendicular to a cabinet side wall and an open retracted position wherein the door is parallel to and alongside the cabinet side wall, and wherein the door is mounted for sliding movement, and wherein the door is slid rearwardly with relation to the side wall after the door is pivotally opened, said suspension system comprising:

a) upper and lower slide track assemblies mountable to the cabinet side wall, said upper and lower slide track assemblies being horizontally disposed parallel to and spaced from each other, each of said upper and lower slide track assemblies having a front end and a rear end;

b) a slide bracket slidably attached to each slide track assembly for movement therealong;

c) a first hinge means connected to the slide bracket attached to said upper slide track assembly for connecting an upper side portion of the cabinet door thereto and a second hinge means connected to the slide bracket attached to said lower slide track assembly for connecting a lower side portion of the cabinet door thereto;

d) an alignment mechanism for maintaining said slide brackets in vertically aligned relationship comprising:

i) first and second cables and a plurality of pulleys, one of said pulleys mounted adjacent each of the front and rear ends of said upper and lower slide track assemblies;

ii) said first cable connected to said upper slide bracket and extending rearwardly therefrom over the pulley at the rear end of said upper slide track assembly, downwardly and over the pulley at the front end of said lower track assembly and rearwardly into connection with said lower slide bracket;

iii) said second cable connected to said upper slide bracket and extending forwardly therefrom over the pulley at the front end of said upper slide track assembly, downwardly and rearwardly over the pulley at the rear end of said lower slide track assembly and forwardly into connection with said lower slide bracket;

iv) whereby said first and second cables are movable with said slide brackets during sliding movement between the open and closed positions of the door and maintain said vertical alignment of said slide brackets regardless of an upward or downward force is exerted on the door.

2. The pocket door suspension system according to claim 1 wherein said cables are substantially inelastic and of the same effective length.

3. The suspension system according to claim 1 and further including an adjustment means mounted on each of said slide brackets for adjusting the effective length of each of said cables.

4. The suspension system according to claim 3 wherein said adjustment mechanism includes an adjustment bracket mounted on the face of said slide bracket and having a pair of end walls extending inward therefrom, a threaded stud extending through an opening in a front wall thereof toward the rear, an internally threaded tubular member slidably extending through an opening in the rear wall of said adjustment bracket and engaged by said threaded stud, the front end of one of said cables being secured to the tubular member, and said threaded fastener being so mounted as to be accessible from the front of said cabinet.

5. The suspension system according to claim 1 wherein said pulley members are mounted on said slide track assemblies.

6. A cabinet having a pair of opposed side walls and further comprising:

a) a pair of doors mounted for pivotal movement between a closed position in which each of said doors is perpendicular to said side walls and an open position wherein said door is parallel to and alongside one of said side walls, and said door being slidable relative to said side wall for movement to a retracted position;

b) a suspension system associated with each side wall for hingedly mounting one of said doors to the associated side wall for pivotal movement between said closed and open positions and for sliding movement relative thereto;

c) upper and lower slide track assemblies mounted to a cabinet side wall parallel to and spaced from each other, each of said upper and lower slide track assemblies having a front end and a rear end;

d) upper and lower slide brackets slidably attached to said upper and lower slide track assemblies, respectively, for movement therealong;

e an alignment mechanism for maintaining said slide brackets in vertically aligned relationship comprising:

i) first and second cables and a plurality of pulleys, one of said pulleys mounted adjacent each of the front and rear ends of said upper and lower slide track assemblies;

ii) said first cable connected to said upper slide bracket and extending rearwardly therefrom over the pulley at the rear end of said upper slide track assembly, downwardly and over the pulley at the front end of said lower track assembly and rearwardly into connection with said lower slide bracket;

iii) said second cable connected to said upper slide bracket and extending forwardly therefrom over the pulley at the front end of said upper slide track assembly, downwardly and rearwardly over the pulley at the rear end of said lower slide track assembly and forwardly into connection with said lower slide bracket;

iv) whereby said first and second cables are moveable with said slide brackets during sliding movement between the open and closed positions of the door and maintain said vertical alignment of said slide brackets regardless of whether an upward or downward force is exerted on said door.

7. The cabinet according to claim 6 wherein said cables are substantially inelastic and of the same effective length.

8. The cabinet according to claim 6 and further including an adjustment means mounted on each of said upper and lower slide brackets for adjusting the effective length of each of said cables.

9. The cabinet according to claim 8 wherein said adjustment mechanism includes an adjustment bracket mounted on the face of said slide bracket and having a pair of end walls extending inward therefrom, a threaded stud extending through an opening in the front wall thereof toward the rear, an internally threaded tubular member slidably extending through an opening in the rear wall of said adjustment bracket and engaged by said threaded stud, the front end of one of said cables being secured to said tubular member, and said threaded fastener being so mounted as to be accessible from the front of said cabinet.

10. The cabinet according to claim 6 wherein said pulley members are mounted on said slide track assemblies.

11. An alignment mechanism for use in a suspension system of the type including upper and lower slide track assemblies being horizontally disposed parallel to and vertically spaced from each other and each having a front end and a rear end, a slide bracket slidably attached to each slide track assembly for movement therealong, the slide brackets supporting the upper and lower portions of at least one end of an object therebetween, said alignment mechanism for maintaining the slide brackets in vertically aligned relationship and comprising:

(a) first and second cables and a plurality of pulleys, one of said pulleys including means for mounting said pulley adjacent the front and rear ends of the upper and lower slide track assemblies;

(b) said first cable having means for mounting said first cable to the upper slide bracket and such that said first cable extends rearwardly therefrom over the pulley at the rear end of the upper slide track assembly, downwardly and over the pulley at the front end of the lower slide track assembly and rearwardly into connection with the lower slide bracket;

(c) said second cable having means for connecting said second cable to the upper slide bracket and such that said second cable extends forwardly therefrom over the pulley at the front end of the upper slide track assembly, downwardly and rearwardly over the pulley at the rear end of the lower slide track assembly and forwardly into connection with the lower slide bracket; and (d) whereby said first and second cables are movable with the slide brackets during sliding movement between open and closed positions and maintain said vertical alignment of the slide brackets regardless of whether an upward or downward force is exerted on the object supported between the slide brackets.

12. The alignment mechanism according to claim 11 wherein said cables are substantially inelastic and of the same effective length.

13. The alignment mechanism according to claim 11 and further including adjustment means connectable between said cables and each of the slide brackets for adjusting the effective length of each of said cables.

14. The alignment mechanism according to claim 13 wherein said adjustment mechanism includes an adjustment bracket mountable on the face of the slide bracket and having a pair of end walls extending inward therefrom, a threaded stud extending through an opening in a front wall thereof toward the rear, an internally threaded tubular member slidably extending through an opening in a rear wall of said adjustment bracket and engaged by said threaded stud and the front end of one of said cables being secured to said tubular member.

15. The alignment mechanism according to claim 11 wherein said pulley members are mountable on the slide track assemblies.

* * * * *

UNITED STATES PATENT AND TRADEMARK OFFICE

CERTIFICATE OF CORRECTION

PATENT NO. : 5,395,165

DATED : March 7, 1995

INVENTOR(S) : Axel G. Woerner

It is certified that error appears in the above—identified patent and that said Letters Patent is hereby corrected as shown below:

Column 6, line 64 :

In Claim 1, paragraph iv), line 5, insert --whether-- before an.

Signed and Sealed this

Thirteenth Day of June, 1995

Bruce Lehman

*Attest:*

BRUCE LEHMAN

*Attesting Officer*

*Commissioner of Patents and Trademarks*